US006533404B1

(12) United States Patent
Olsen

(10) Patent No.: US 6,533,404 B1
(45) Date of Patent: Mar. 18, 2003

(54) INK SUPPLY FOR PREVENTING THE PASSAGE OF AIR

(75) Inventor: David Olsen, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 1027 days.

(21) Appl. No.: 08/705,507

(22) Filed: Aug. 28, 1996

(51) Int. Cl.[7] ..... B41J 2/19; B41J 2/175
(52) U.S. Cl. ..... 347/92; 347/93
(58) Field of Search ..... 347/92, 85, 93, 347/86, 87

(56) References Cited

U.S. PATENT DOCUMENTS 4,558,326 A * 12/1985 Kimura et al. ..... 347/86
4,771,295 A * 9/1988 Baker et al. ..... 347/87
5,280,300 A 1/1994 Fong et al. ..... 347/87
5,426,459 A 6/1995 Kaplinsky ..... 347/87
5,491,501 A * 2/1996 Dietl et al. ..... 347/86
5,821,965 A 10/1998 Oda et al. ..... 347/86

FOREIGN PATENT DOCUMENTS

JP 60-198255 * 10/1985 ..... 347/93
JP 3-189157 * 11/1991

* cited by examiner

*Primary Examiner*—Judy Nguyen
(74) *Attorney, Agent, or Firm*—Kevin B. Sullivan

(57) ABSTRACT

The present invention is an ink supply for use in an inkjet printing system of the type having an ink jet printhead spaced from the ink supply. The ink jet printing system has an ink conduit configured for connection to each of the printhead and the ink supply for providing ink to the ink jet printhead. The ink supply includes an ink container for storing ink and a fine mesh disposed in a fluid path between the ink container and the ink conduit. The fine mesh has a mesh opening size which does not permit air to pass therethrough under normal nominal air bubble pressure experienced by the ink jet printing system in normal usage and storage.

7 Claims, 3 Drawing Sheets

INK SUPPLY FOR PREVENTING THE PASSAGE OF AIR

BACKGROUND OF THE INVENTION

The present invention relates to ink jet printers, and more particularly, to printing systems which employ off axis ink supplies connected to a carriage mounted printhead via tubing.

Ink jet printers are well known in the art, and many utilize a carriage which carries one or more ink jet cartridges. These carriages typically carry the printheads in a traversing or scanning movement, transverse to the printer paper path. It is also well known to provide an external stationary ink reservoir connected to the scanning cartridge via a tube. The external reservoir is typically known as an "off axis" ink reservoir. While providing increased ink capacity, these off axis systems present a number of problems. One problem is that of vapor losses from the tubing and air diffusion into the tubing system. A tube material that has been used is LDFE (low density polyethylene), since it is a low modulus material which is easy to bend. This low modulus material suffers from relatively high vapor losses and air diffusion into the tube. As a result of the vapor losses, the ink can change properties, degrading print quality and eventually causing tube or printhead clogging. Another problem with air diffusion into the tubing is that the printhead can ingest this air as ink is drawn from the external reservoir. As a result of air ingestion, the printhead can fill with air. During thermal fluctuations, the air can expand, causing printhead drool.

Another problem relating to printhead air ingestion is that this ingested air in the printhead can cause printhead starvation. Printhead starvation results when air enters a bubble chamber and displace ink, reducing the ink volume in the bubble chamber. As a heating element is heated to form a vapor bubble to eject ink from the bubble chamber the volume of ink ejected is reduced by the air in the chamber, reducing the quality of the output image. In addition, the reduced volume of ink ejected reduces the cooling of the heating element tending to reduce the lifetime of the printhead.

Air enters the tube connecting the reservoir with the printhead in two predominant ways. The first is air from the external reservoir can enter the tube. Air enters the external reservoir either through diffusion into this reservoir or during the filling process of the external reservoir air may become entrapped within the reservoir. As ink is drawn from the external reservoir the entrapped air within the reservoir is drawn into the tube. A second way in which air enters the tube is through diffusion of air from outside of the tube to the inside of the tube. Once air is present within the tube any increases in air within the tube produces an increase in the diffusion rate of air through the tube material, further exacerbating the problem of air ingestion in the printhead.

U.S. Pat. No. 5,426,459 to Kaplinski, assigned to the assignee of the present invention, incorporated herein by reference discloses the use of a section of finely woven stainless steel mesh as a combined filter and air check valve for use in an "on axis" type print cartridge. An on axis print cartridge makes use of a printhead which is integrated with an ink reservoir. Therefore, an external tube is not required to fluidly connect the printhead and the reservoir. The air check valve is provided in the fluid path between the printhead and the ink reservoir to prevent air bubbles from traveling from the printhead into the reservoir. The valve also serves the function of a filter to prevent particulate contaminants from flowing from the ink reservoir into the printhead and clogging the printhead nozzles. The Kaplinski reference deals with the problem of leakage of air bubbles into the ink reservoir which equalizes the pressure on the ink in the reservoir reducing the negative pressure which is required to prevent the printhead from drooling when the printhead is subject to minor shocks during handling or operation. The Kaplinski reference does not deal with an off axis type printing system and therefore does not recognize the problem of introduction of air into the printing system via an external ink supply or the problem of air diffusion into the tube connecting the external reservoir with the printhead.

There is an ever present need of techniques for preventing the introduction of air into the printhead via the external reservoir in off axis printing systems. This technique should be a reliable way of preventing air ingestion by the printhead which reduces the printhead life. In addition, this technique should be relatively inexpensive and well suited to the manufacturing environment to reduce manufacturing costs of both the external reservoir as well as the off axis printing system.

SUMMARY OF THE INVENTION

The present invention is an ink supply for use in an ink jet printing system of the type having an ink jet printhead spaced from the ink supply. The ink jet printing system has an ink conduit configured for connection to each of the printhead and the ink supply for providing ink to the ink jet printhead. The ink supply includes an ink container for storing ink and a fine mesh disposed in a fluid path between the ink container and the ink conduit. The fine mesh has a mesh opening size which does not permit air to pass therethrough under normal nominal air bubble pressure experienced by the ink jet printing system in normal usage and storage. In one preferred embodiment the mesh is a wire mesh having a mesh size in the range from 10 microns to 100 microns. In this preferred embodiment the mesh is positioned within the ink container.

DETAILED DESCRIPTION OF THE PREFERRED EMBODIMENT

Figure 1:
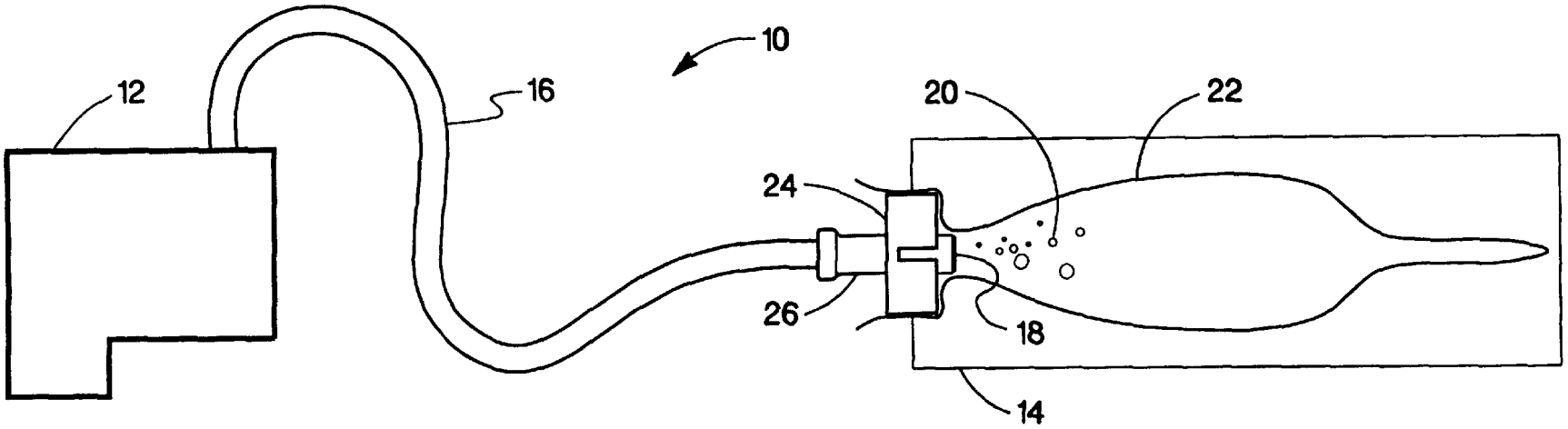
FIG. 1 is a simplified schematic diagram of an ink jet printhead connected via a length of tubing to an off axis ink reservoir, with an air bubble in the off axis ink reservoir to illustrate the air introduction into the printing system problem addressed by the, present invention.

FIG. 1 is a simplified representation of an off axis printing system 10 which makes use of an off axis or external ink reservoir. The printing system 10 includes a printhead 12, an external reservoir 14 and a tube or conduit 16 fluidically connecting the printhead 12 with the external reservoir 14. A scanning carriage (not shown) moves the printhead 12 as ink droplets are selectively ejected from the printhead 12 onto print media such as paper. Under normal conditions the printhead 12 is under a slight negative pressure which is used to draw ink from the external reservoir through tube 16 to the printhead 12. The external reservoir 14 includes a bubble screen 18 which is the subject of the present invention for preventing air, represented by bubble 20, trapped within the external reservoir 14 from entering the tube 16 and printhead 12. As air increases within the tube 16 the diffusion rate of air through the tube 16 from outside of the tube 16 tends to increase. This air within the tube 16 is drawn into the printhead 12 which can result in air ingestion in the printhead which can result in printhead overheating reducing the printhead life. In addition, air ingestion into the printhead 12 can result in printhead 12 drool due to thermal fluctuations or air pressure changes.

The external reservoir 14 includes a flaccid bag 22 which is attached to a fitment 24. The fitment 24 includes a fluid interconnect 26 for connecting to a corresponding fluid interconnect (not shown) attached to the tubing 16. The fitment 24 and the corresponding fluid interconnects allow the external reservoir 14 to be replaced when the fluid within the external reservoir 14 is exhausted.

The bubble screen 18 of the present invention prevents air within the external reservoir 14 for entering either the tubing 16 or the printhead 12. Air which enters tubing 16 forms a bubble referred to as a "seed bubble". The larger the seed bubble or area in contact with the tube 16 wall, the larger the diffusion rate of air into the tube 16. Both the air entering tube 16 from the external reservoir 14 and the air which diffuses into the tube 16 from the outside is drawn into the printhead 12 which can result in drooling problems as well as a reduction in the printhead 12 life.

Once air is present in the tube 16 which extends between the printhead 12 and the external reservoir 14, then further air diffusion into the tube 16 becomes a greater problem. The pressure of the outside atmosphere (outside the tube), the total pressure within the bag 22, and the total bubble pressure are equalized (assume they are level and static), as represented by the following equation:

$$P_{tot,tube}=P_{tot,bag}=P_{tot,outside}$$

Where $P_{tot,tube}$ tube represents the total pressure in the tube 16, $P_{tot,bag}$ represents the total pressure in the bag 22 and $P_{tot,outside}$ represents the total pressure outside the bag 22 and tube 16. The total pressure is equal to air (primarily oxygen and nitrogen, not counting vapors) pressure plus partial pressure of vapor, as represented by the following:

$$P_{tot,tube}=P_{air,tube}+P_{vapor,tube}=P_{air,outside}+P_{vapor,outside}$$

Where $P_{air,tube}$ is the air pressure in the tube 16, $P_{vapor,tube}$ is the partial pressure of vapor in the tube 16, $P_{air,outside}$ is the pressure of air outside and $P_{vapor,outside}$ is the partial pressure of vapor outside the tube 16. Therefore, rearranging the above yields the following equation:

$$(P_{air,outside}-P_{air,tube})=(P_{vapor,tube}-P_{vapor,outside})$$

The vapor air in the tube 16 is fully saturated. However, the pressure of vapor outside may vary. Air will tend to diffuse through the tube material toward in the direction of highest pressure of vapor. For example, in Arizona the vapor pressure may be very low. In Florida, it would be typically very high. In dry environments, such as Arizona, the diffusion rate of air from outside the tube 16 into the tube 16 can be very high.

With low performance tubing materials, the diffusion rate of air into the tubing 16 is further increased. In addition, the more air within the tube 16 the greater the rate of diffusion of air into the tube 16 from outside of the tube further increasing the air entering the printhead 12. Therefore, it is important that air be prevented from entering the tube 16 to limit air ingestion by the printhead 12.

Figure 2:
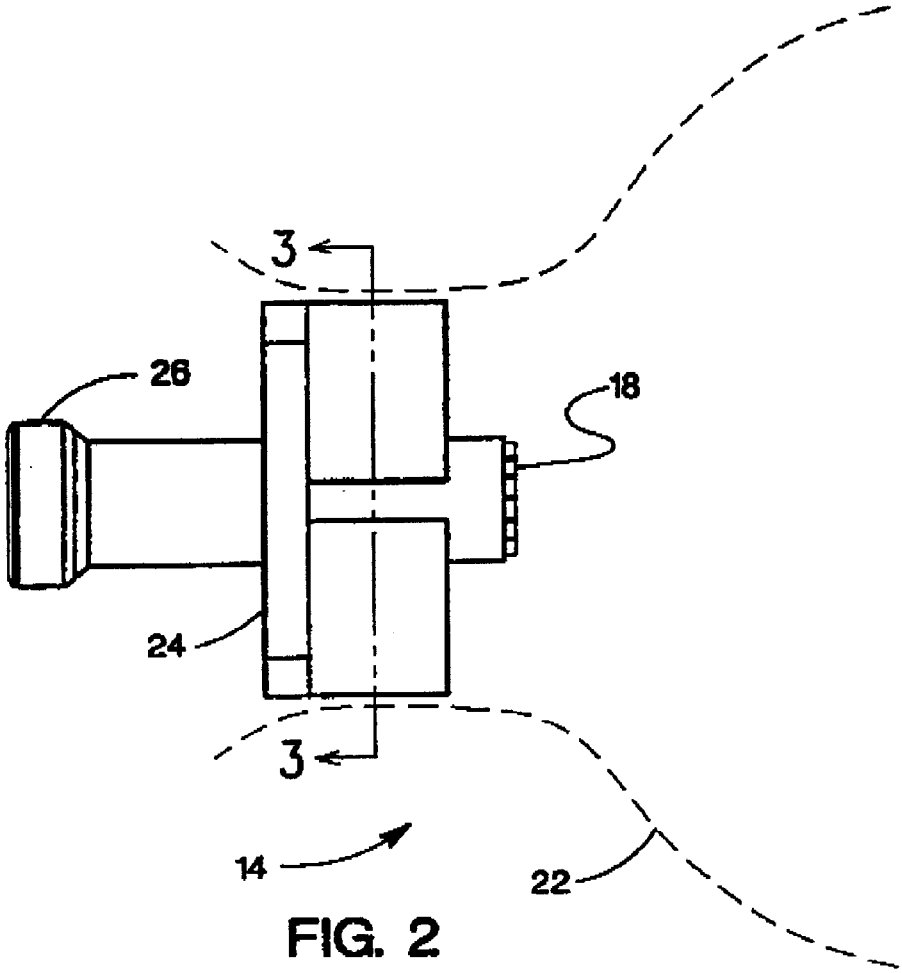
FIG. 2 is a simplified schematic diagram of the external reservoir which includes a fitment having the bubble screen of the present invention attached thereto and with a flaccid bag partially shown with dotted lines.

FIG. 2 shows a greatly enlarged view of the fitment 24 having the bubble screen 18 of the present invention mounted therein with the bag 22 partially shown with dotted lines. The fitment 24 includes a fluid interconnect 26 for fluidly connecting the external reservoir 14 with a fluid interconnect (not shown) attached to the tube 16. This fluid interconnect 26 allows the flow of fluid from bag 22 to tube 16 and then into printhead 12. The fluid interconnect 26 allows fluid to flow from the external reservoir 14 only when properly connected to the corresponding fluid interconnect associated with tube 16. In one preferred embodiment the fluid interconnect associated with the tube 16 is a needle valve and the fluid interconnect 26 associated with the external reservoir 14 is a septum and popit valve. The use of the fluid interconnect 26 on the external reservoir 14 allows the external reservoir 14 to be handled and stored without ink spillage as well as limit or prevent the introduction of air into the external reservoir 14.

The bag 22 is attached to the fitment to form a hermetic seal for preventing ink leakage. The hermetic seal between the fitment 24 and the bag 22 may be formed by welding, bonding with adhesives or some conventional technique.

Figure 3:
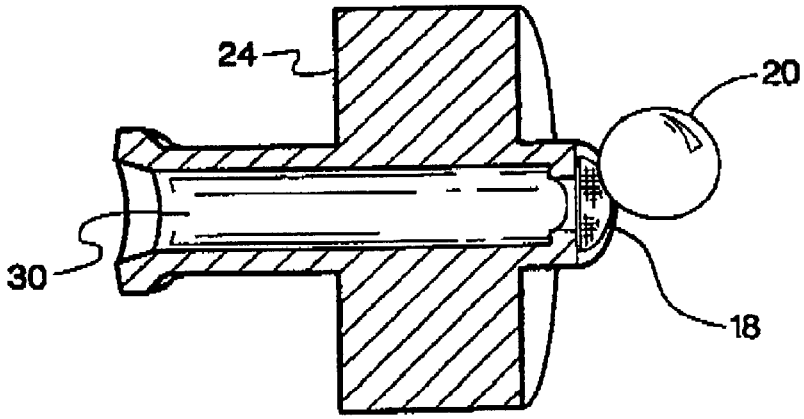
FIG. 3 shows the fitment of FIG. 2 in section, taken across a plane defined by 3–3, shown in perspective, with an air bubble positioned in front of the bubble screen.

FIG. 3 is a section of the fitment 24 taken across a plane defined by 3–3, shown in perspective. The fluid interconnect 26 details are not shown in FIG. 3 for simplicity. The bubble screen 18 of the present invention is positioned on the fitment 24 to extend across the fluid path 30 within the fitment 24. The bubble screen 18 is shown in more detail in FIG. 4. The bubble screen 18 prevents bubbles such as bubble 20 from passing through the fluid path 30 and into the tube 16.

Negative pressure on the ink within the external reservoir 14 will tend to draw ink as well as any entrapped air bubbles such as bubble 20 through the fitment 24 into the tube 16 and through the printhead 12. The bubble screen 18 is a fine mesh having an opening size which does not permit air bubbles to pass therethrough under normal air bubble pressure experienced by the printhead 12 in the normal usage or storage.

In one preferred embodiment the bubble screen 18 is a section of finely woven stainless steel mesh, the edges of which are attached to the fitment 24. The mesh passage size is sufficiently small that while ink may pass through the passages of the mesh, air bubbles under normal atmospheric pressure will not pass through the mesh passages which are wetted by the ink. The required air bubble pressure necessary to permit bubbles to pass through the mesh, in this embodiment, about 30 inches of water, is well above that experienced by the printhead 12 under typical storage, handling or operational conditions. As a result, the mesh serves the function of a bubble screen for preventing air from entering both the tubing 16 and the printhead 12.

Figure 4:
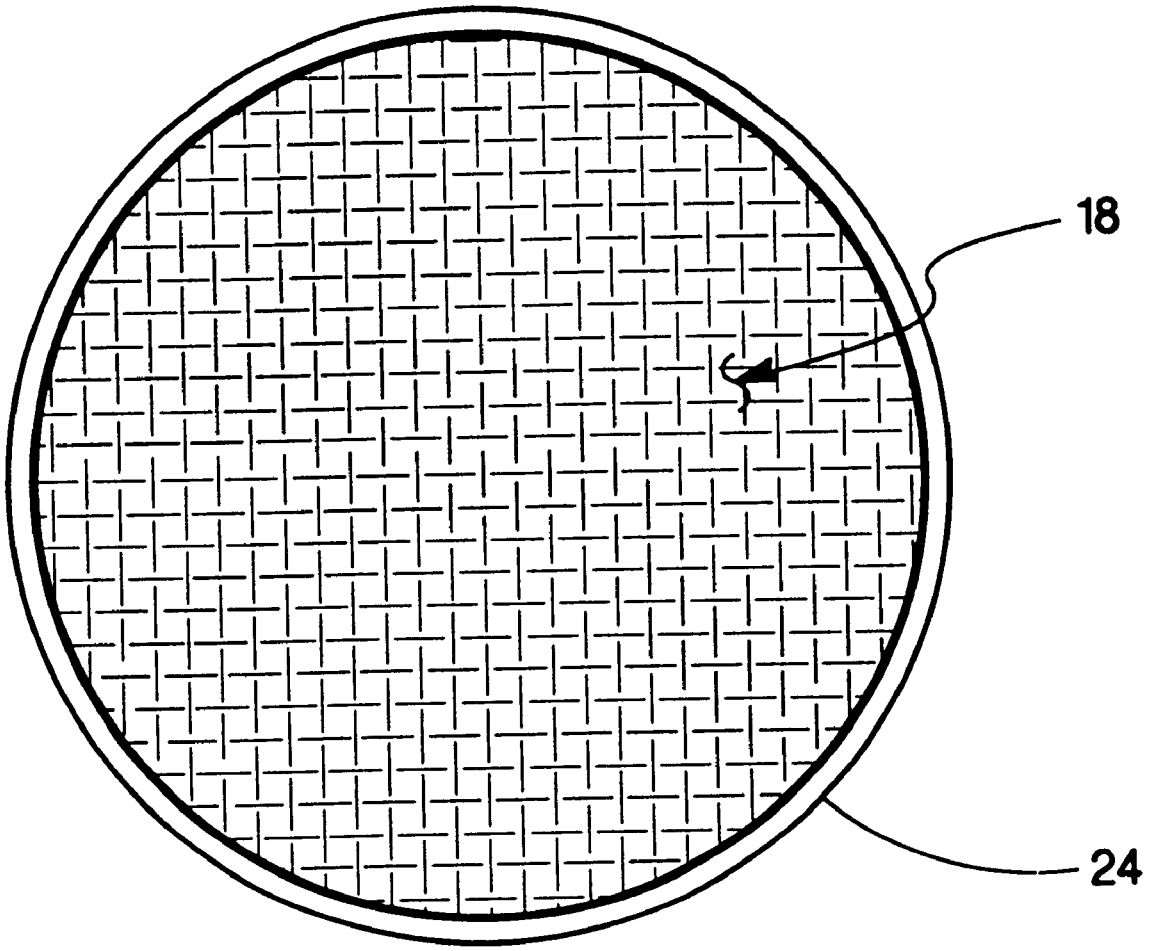
FIG. 4 shows a representation of the bubble screen of the present invention as viewed in the direction of fluid flow through the fitment.

FIG. 4 is a view of the screen 18 as viewed from inside the bag 22 looking out through the fluid path 30. The screen 18 is attached to the inner wall of the fitment 24 for preventing bubbles from passing around the bubble screen 18 and entering the tube 16. The weave shown in FIG. 4 is only for illustrative purposes and is not to represent the only type of weave suitable for the bubble screen 18. A wide variety of screen weaves may be suitable for preventing air from passing. One particular weave that was suitable is a twilled dutch weave type mesh.

In general, the weave size of the screen 18 will depend on ink characteristics within the external reservoir 14. It is the surface tension which prevents bubbles larger than the screen mesh from breaking up and passing through the screen 18. Therefore, changes in surface tension of the ink will require appropriate changes in the bubble screen size to ensure bubbles do not pass through the screen 18. In addition, the weave size will be dependent on pressure differential across the screen 18. In general, the greater the pressure differential across the screen 18 the smaller the weave or mesh size required to prevent bubble passage through the screen 18. In one preferred embodiment the screen size is in the range from 10 microns to 100 microns.

In the case of a negative pressure printhead 12, the pressure differential drop across the bubble screen 18 is based on negative pressure created by the printhead 12. For one type of negative pressure printhead 12 the negative pressure produced by the printhead 12 is below 30 inches of water. If the printhead 12 creates greater negative pressure or if the external reservoir 14 is pressurized, each of which may produce a pressure drop across the bubble screen 18 which is greater than 30 inches of water then a smaller mesh size would be required to prevent bubbles from passing through the mesh and into the tube 16.

Although the bubble screen 18 is described as a mesh, a variety of other structures such as a porous material such as Gortex™ having proper hole sizes is also suitable.

What is claimed is:

1. An ink jet printing system for forming images on print media, the ink jet printing system comprising:

a printhead configured for mounting in a scanning carriage for ejecting ink onto print media in response to print signals;

an ink container spaced from the printhead for storing ink;

a fitment structure attached to the ink container, said fitment structure including a fluid interconnect, said fitment structure having a fluid path for passing ink therethrough between the fluid interconnect and the ink container;

an ink conduit connected between the printhead and the fluid interconnect for providing ink from the ink container to the printhead, said fluid interconnect adapted for detachable connection to the ink conduit; and a fine mesh structure disposed in the fluid path such that ink passing into the ink conduit from the ink container passes through the mesh structure, the fine mesh structure having a mesh opening size which is sufficiently small to prevent air bubbles from passing through the fluid outlet under nominal air bubble pressure experienced by the ink jet printing system in usage and storage.

2. The ink jet printing system of claim 1 further including a quantity of liquid ink disposed within the ink container.

3. The ink jet printing system of claim 1 wherein the ink container includes a flexible bag for holding a supply of liquid ink, and said fitment structure is attached to said flexible bag.

4. A method for providing ink from an ink container to an ink jet printhead spaced from the ink container, the ink container and the ink-jet printhead having an ink conduit detachably connected therebetween, the method comprising:

attaching a fitment structure to the ink container, said fitment structure including a fluid interconnect adapted for detachable connection to the ink conduit, said fitment structure having a fluid path for passing ink between the ink container and the fluid interconnect;

disposing a structure (defining a fine mesh within the ink container across said fluid path;

detachably connecting the fluid interconnect to the ink conduit to provide a fluidic connection between the ink container and the ink jet printhead; and providing a pressure differential between the ink jet printhead and the ink container sufficient for ink to pass from the ink container through the fitment structure and the structure defining a fine mesh to the ink jet printhead, the structure defining a fine mesh sized to prevent air from passing through the fine mesh under the pressure differential provided.

5. The method of claim 4 further comprising the step of providing a flexible bag for use as the ink container, and the step of attaching a fitment structure to the ink container includes attaching the fitment structure to a flexible wall of the flexible bag.

6. The method of claim 4 further including the step of disposing a quantity of liquid ink within the ink container.

7. An ink supply for use in an ink jet printing system, the ink jet printing system having an ink jet printhead spaced from the ink supply, the ink jet printing system having an ink conduit configured for detachable connection between the printhead and the ink supply for providing ink to the ink jet printhead, the ink supply comprising:

an ink container for storing ink;

a fitment structure attached to the ink container, said fitment structure including a fluid interconnect, said fluid interconnect adapted for detachable connection to the ink conduit, said fitment structure having a fluid path for passing liquid ink therethrough between the fluid interconnect and the ink container; and means disposed in said fluid path between the ink container and the fluid interconnect for limiting air passage from the fluid path under nominal air bubble pressure experienced by the ink jet printing system, wherein said means disposed in said fluid path for limiting air passage from the fluid path comprises a fine mesh structure disposed across said fluid path and within said fluid container, said mesh structure having a mesh opening size that is small enough to prevent air from passing.

* * * * *

UNITED STATES PATENT AND TRADEMARK OFFICE

CERTIFICATE OF CORRECTION

PATENT NO. : 6,533,404 B1
DATED : March 18, 2003
INVENTOR(S) : David Olsen

It is certified that error appears in the above-identified patent and that said Letters Patent is hereby corrected as shown below:

Column 6,
Line 11, delete "(" after the word "structure".

Signed and Sealed this

Third Day of February, 2004

JON W. DUDAS
*Acting Director of the United States Patent and Trademark Office*